US011523633B2

(12) United States Patent
Aliko

(10) Patent No.: US 11,523,633 B2
(45) Date of Patent: Dec. 13, 2022

(54) CONFIGURABLE HERB GRINDER

(71) Applicant: David Aliko, Toronto (CA)

(72) Inventor: David Aliko, Toronto (CA)

( * ) Notice: Subject to any disclaimer, the term of this patent is extended or adjusted under 35 U.S.C. 154(b) by 255 days.

(21) Appl. No.: 16/856,097

(22) Filed: Apr. 23, 2020

(65) Prior Publication Data

US 2021/0329970 A1 Oct. 28, 2021

(51) Int. Cl.
*A24F 23/04* (2006.01)
*A24B 7/00* (2006.01)
*B26B 27/00* (2006.01)

(52) U.S. Cl.
CPC ..... *A24F 23/04* (2013.01); *A24B 7/00* (2013.01); *B26B 27/00* (2013.01)

(58) Field of Classification Search
None
See application file for complete search history.

(56) References Cited

U.S. PATENT DOCUMENTS 8,393,563 B2 * 3/2013 Chaoui ..... B02C 18/24 241/273.3
8,695,906 B2 4/2014 Hainbach
9,510,709 B2 12/2016 Wilson et al.
9,757,733 B1 9/2017 Dukat
11,224,311 B2 * 1/2022 Aryanpanah ..... A47J 42/34
2010/0200581 A1 * 8/2010 Maltz ..... B65D 43/165 220/326
2013/0264346 A1 * 10/2013 Donahue ..... A62C 3/16 220/560.01
2018/0338642 A1 * 11/2018 Staiano ..... B02C 23/10
2021/0329970 A1 * 10/2021 Aliko ..... A24F 23/04

FOREIGN PATENT DOCUMENTS

CA 2 994 887 * 8/2019
DE 20 2012 006 296 U1 * 10/2012
DE 10 2017 114 839 A1 * 1/2019
GB 2557859 A * 7/2018
WO WO 2010/133524 A1 * 11/2010

OTHER PUBLICATIONS

English translation of DE 20 2012 006 296 U1, Oct. 2012.*

* cited by examiner

*Primary Examiner* — Hwei-Siu C Payer
(74) *Attorney, Agent, or Firm* — Orin Del Vecchio

(57) ABSTRACT

A configurable herb grinder that is operable to provide grinding of a desired herb wherein the configurable herb grinder of the present invention includes a first configuration and a second configuration. The configurable herb grinder of the present invention includes a first grinding member module and a second grinding member module that are rotatably coupled and arranged in a vertically stacked orientation. The herb grinder further includes a container member module and a bottom member module that are beneath the first grinding member module and the second grinding member module in a vertically stacked orientation. The first grinding member module and the second grinding member module comprise the upper portion of the herb grinder and the container member module and the bottom member module comprise the lower portion. The herb grinder is configured to interchange the upper portion and lower portion utilizing latches and latch receptacles.

11 Claims, 4 Drawing Sheets

CONFIGURABLE HERB GRINDER

FIELD OF THE INVENTION

The present invention relates generally to grinding devices, more specifically but not by way of limitation, an herb grinder for herbs such as but not limited to cannabis wherein the herb grinder is comprised of a plurality of vertically stacked segment wherein the segments are secured utilizing a quick release latch and are further configurable in a first orientation and a second orientation.

BACKGROUND

Herb grinding is well known in the art. Various types of herb grinders exist in the field and can be used on herbs such as those utilized for cooking as well as those utilized for other purposes such as but not limited to cannabis. Conventional manual herb grinders often have rotatable segments wherein the lower portions are secured to the upper portion utilizing threads. The use of conventional threads requires a user to engage these types of devices with two hands. Engaging these devices with two hands may sometimes be either inconvenient for a user or just not physically possible when the requirement of releasing the upper portion and lower portion is needed.

Another issue with conventional grinders is their inability to be reconfigured and utilized in alternate configurations. Conventional stack grinders are designed to be utilized wherein the modular components thereof are vertically stacked in a specific order. The herbs are loaded into a receptacle having upward teeth and a cover having intertwined downwardly extending teeth is superposed and ensuingly the cover is rotated. When conventional grinders are disassembled there is no technique to secure the modular elements in an alternate configuration.

Accordingly, there is a need for a herb grinder wherein the herb grinder is operable to be configured in a first configuration and a second configuration and wherein the modules are operably secured utilizing a quick release latch to facilitate use with engagement of only one hand if desired.

SUMMARY OF THE INVENTION

It is the object of the present invention to provide a herb grinder operable to have at least two configurations wherein the herb grinder includes a body that is cylindrical in shape.

Another object of the present invention is to provide a configurable herb grinder operable to facilitate the grinding of various herbs wherein the body of the present invention is comprised of vertically stacked modules.

A further object of the present invention is to provide a herb grinder operable to have at least two configurations wherein the vertically stacked modules include an upper portion and a lower portion.

An additional object of the present invention is to provide a configurable herb grinder operable to facilitate the grinding of various herbs wherein the upper portion and lower portion are releasably secured utilizing a quick release latch.

Yet a further object of the present invention is to provide a herb grinder operable to have at least two configurations wherein the lower portion further includes latch receptacles that are configured to operably engage the latch mechanism of the present invention.

A further object of the present invention is to provide a configurable herb grinder operable to facilitate the grinding of various herbs wherein the lower portion includes a bottom member and wherein the bottom member further includes latch receptacles formed therein.

Another object of the present invention is to provide a herb grinder operable to have at least two configurations wherein the lower portion further includes a container member that is configured to receive and retain ground herbs.

An additional object of the present invention is to provide a configurable herb grinder operable to facilitate the grinding of various herbs wherein the lower portion includes a bottom member and the bottom member is configured with an interior volume operable to capture smaller particles from the container member.

Still a further object of the present invention is to provide a herb grinder operable to have at least two configurations wherein in a second configuration the members of the lower portion are superposed the members of the upper portion.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
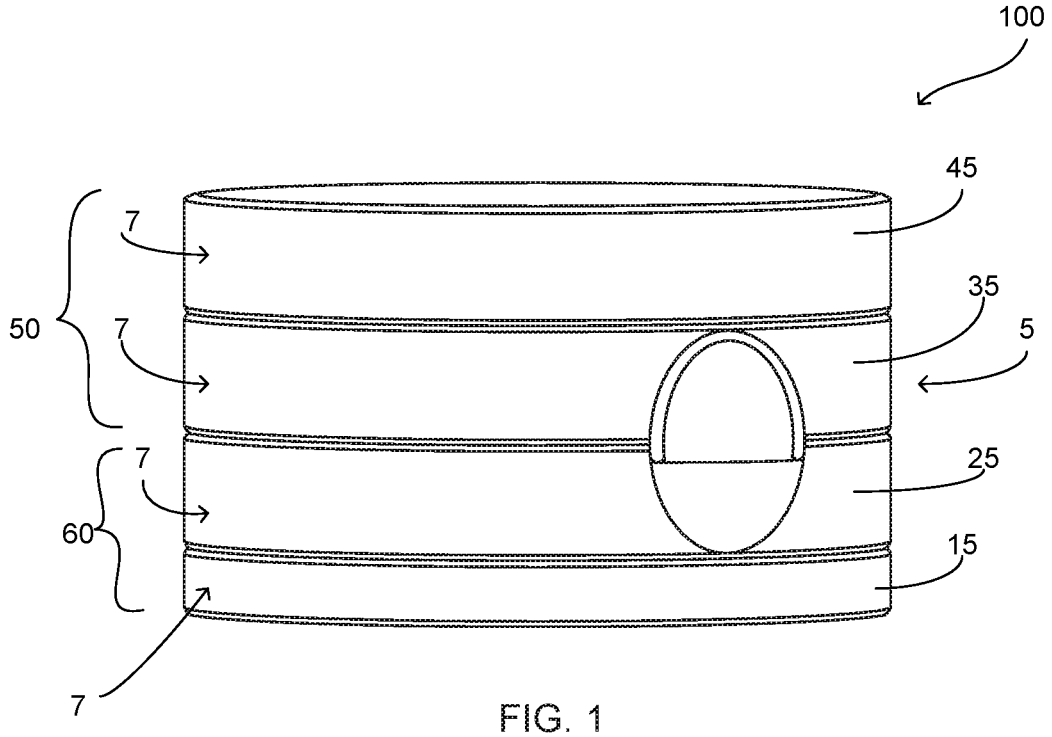
FIG. 1 is a perspective view of the present invention.
Figure 2:
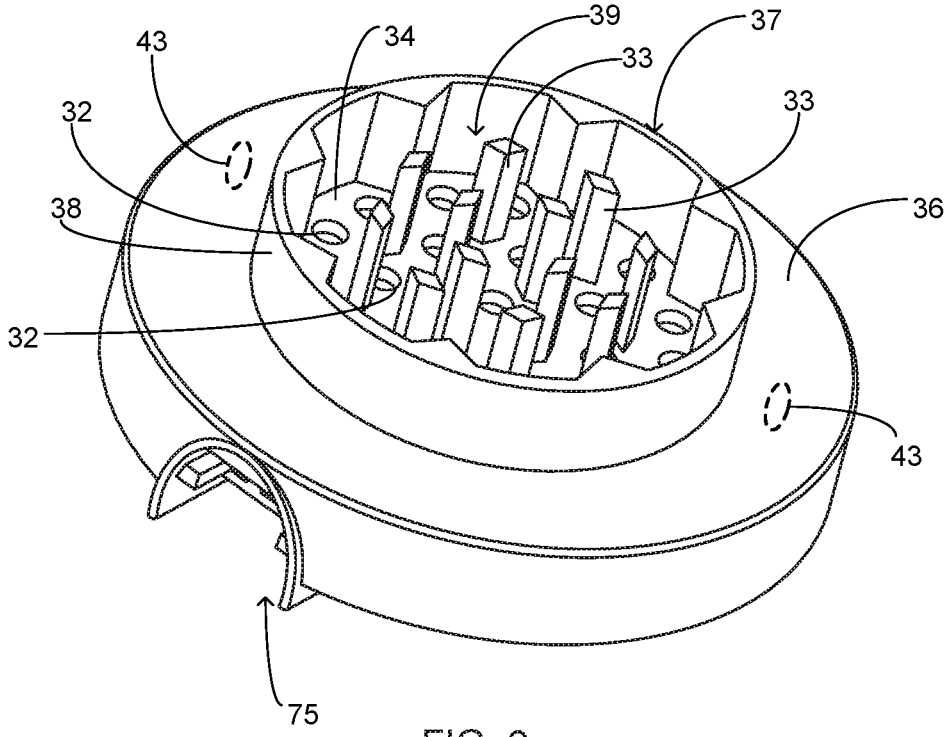
FIG. 2 is a top perspective view of the second grinding member module.
Figure 3:
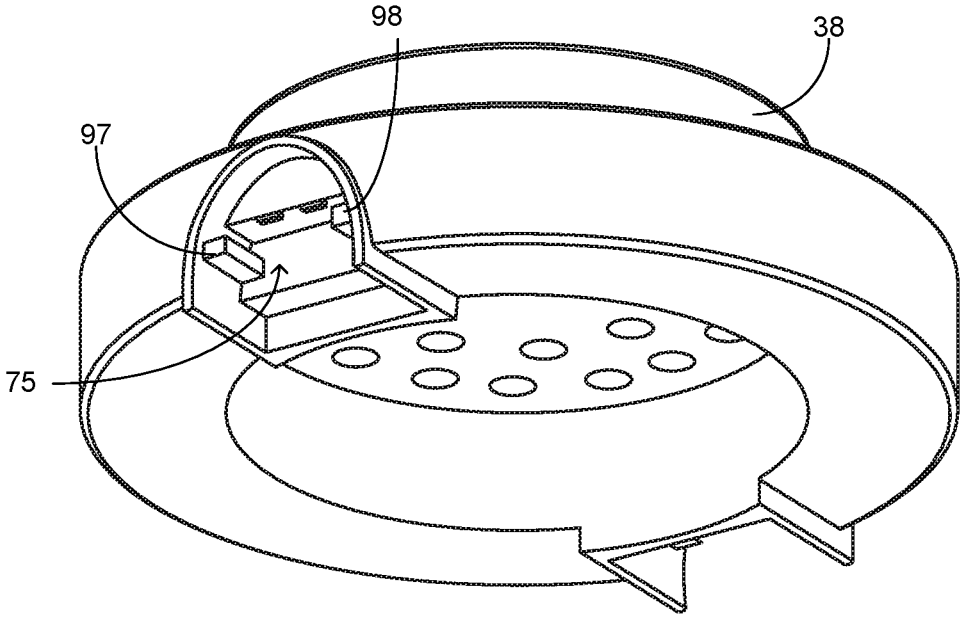
FIG. 3 is a bottom perspective view of the second grinding member module.
Figure 4:
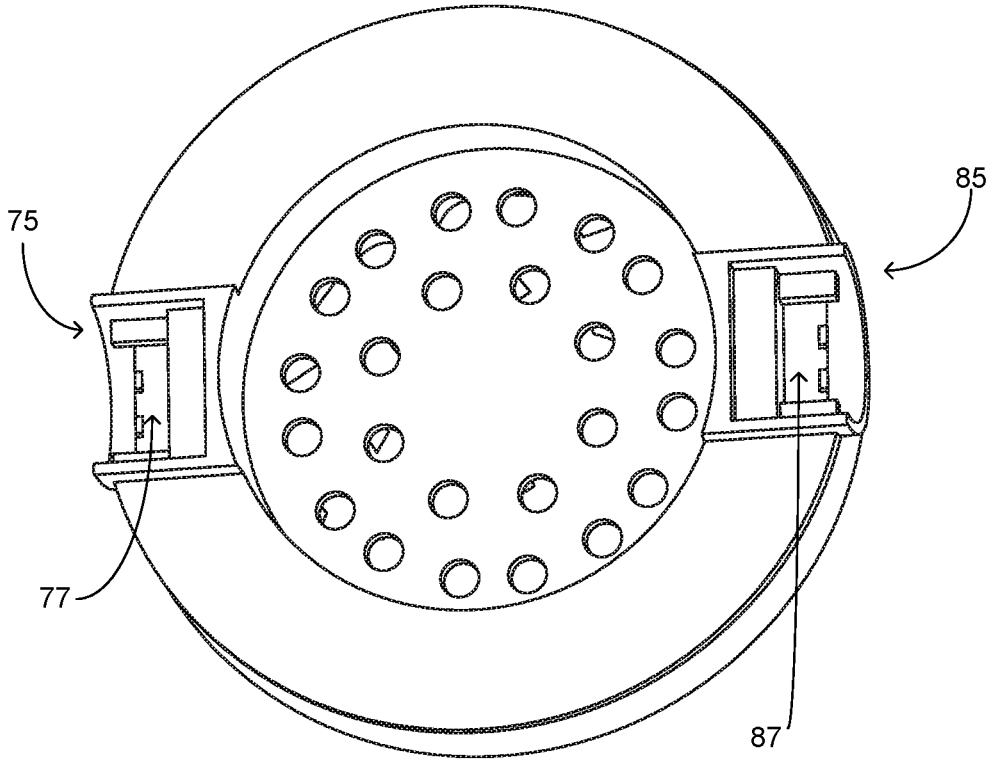
FIG. 4 is a bottom view of the second grinding member module.
Figure 5:
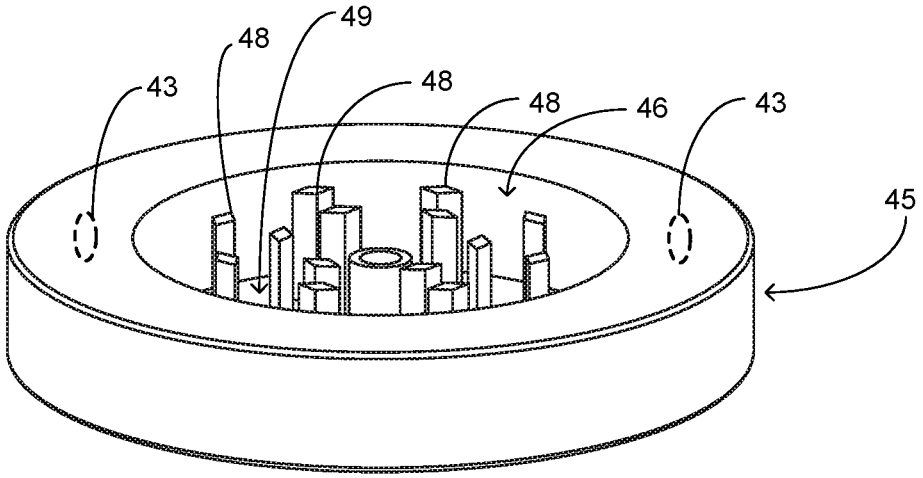
FIG. 5 is an internal perspective view of the first grinding member module.

Referring now to the drawings submitted herewith, wherein various elements depicted therein are not necessarily drawn to scale and wherein through the views and figures like elements are referenced with identical reference numerals, there is illustrated a configurable herb grinder 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith the configurable herb grinder 100 includes a body 5 wherein the body 5 is comprised of a plurality of operably coupled modules 7. The body 5 includes a lower end and an upper end. The plurality of modules 7 as moving from lower end to upper end are as follows: bottom member module 15, container member module 25, second grinding member module 35 and first grinding member module 45. The second grinding member module 35 and first grinding member module 45 comprise the upper portion 50 of the body 5. The lower portion 60 of the body 5 is comprised of the bottom member module 15 and the container member module 25. The body 5 in a preferred embodiment is cylindrical in shape but it is contemplated within the scope of the present invention that the body 5 could be formed in alternate shapes and further be provided in various sizes. As will be further discussed herein, the configurable herb grinder 100 includes a first configuration and a second configuration wherein the second configuration provides an alternative use of the configurable herb grinder 100 in an alternate module 7 configuration.

The first grinding member module 45 is rotatably coupled to the second grinding member module 35. The first grinding member module 45 and second grinding member module 35 further include a plurality of magnets 43. The magnets 43 provide sufficient coupling to maintain the first grinding member module 45 in connection with the second grinding member module 35 when not in use but do not interfere with the ability for a user to rotate the first grinding member module 45 as is further discussed herein. It should be understood within the scope of the present invention that the configurable herb grinder 100 could have as few as two magnets or a plurality of magnets in order to accomplish the desired objective stated herein. The first grinding member module 45 includes an interior volume 46 having a plurality of teeth 48 formed therein. The teeth 48 extend outward from the upper inner surface 49 of the interior volume 46. In the first configuration operational position, shown in FIG. 1, the teeth 48 extend downward towards the second grinding member module 35. A plurality of teeth exist and sufficient space exists therebetween to accommodate an herb such as but not limited to cannabis. The teeth 48 illustrated herein are square rod shaped but it is contemplated within the scope of the present invention that the teeth 48 could be formed in alternate shapes.

The second grinding member module 35 includes a support ledge 36 wherein the support ledge 36 provides a support surface for the first grinding member module 45 when the first grinding member module 45 is superposed the second grinding member module 35. A grinding receptacle 37 is defined by wall 38 wherein the grinding receptacle 37 includes an interior volume 39 being of sufficient size to accommodate an herb therein. The grinding receptacle 37 includes a bottom 34 wherein a plurality of teeth 33 extend upward from the bottom 34. The teeth 33 are aligned with the spaces in between the teeth 48 wherein the tolerances between the teeth 48 and teeth 33 are relatively small so as to grind any herb present to small particles. The bottom 34 further includes a plurality of apertures 32 wherein the apertures 32 facilitate the transfer of herb particles to the container member module 25 during the grinding process.

The second grinding member module 35 further includes latch receptacles 75, 85. The latch receptacles 75, 85 are formed to operably receive therein latch 90. Latch 90 functions to releasably secure the upper portion 50 of the body 5 to the lower portion 60. Ensuing the utilization of the first grinding member module 45 and second grinding member module 35 to grind a desired herb, the latches 90, present in latch receptacles 75, 85 are utilized to separate the upper portion 50 and lower portion 60. While two latch receptacles 75, 85 are illustrated herein, it is contemplated within the scope of the present invention that the configurable herb grinder 100 could employ just a single latch and latch receptacle to separate the upper portion 50 and lower portion 60. Use of the latch 90 provides the ability for the body 5 to be separate as discussed herein with just one hand of the user. The latch receptacles 75, 85 are arcuate in form having a void 77, 87 operable to accommodate the body 91 of the latch 90 therein. The latch 90 includes a biasing element holder 92 that is configured to receive therein a biasing element (not illustrated herein) such as but not limited to a spring wherein the biasing element functions to provide the necessary force to hold the latch in position until the latch 90 is depressed by a user. When the latch 90 is depressed by a user, the lower lip member 94 disengages from the container member module so as to facilitate the release of the upper portion 50 from the lower portion 60. The latch 90 further includes opposing slots 95, 96 formed in the body 91. The opposing slots 95, 96 are aligned to mateably engage guide members 97, 98 wherein the guide members 97, 98 are slidable within the opposing slots 95, 96 and function to provide a balanced travel of the latch 90 when being depressed by a user.

Figure 6:
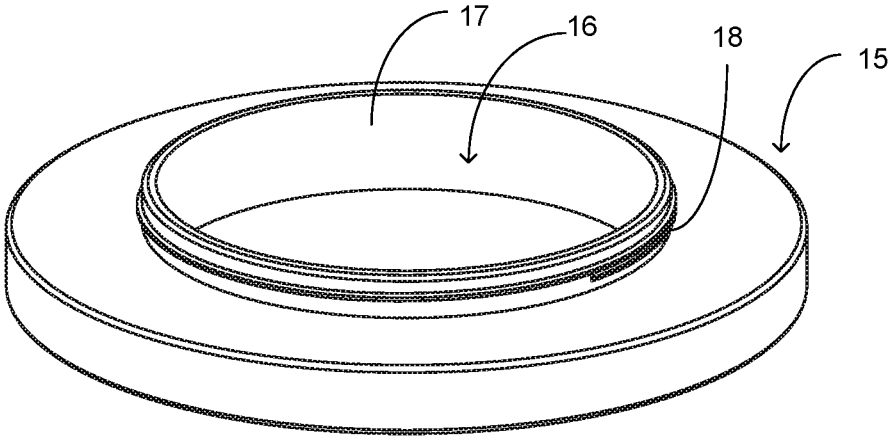
FIG. 6 is a perspective view of the bottom member module.
Figure 7:
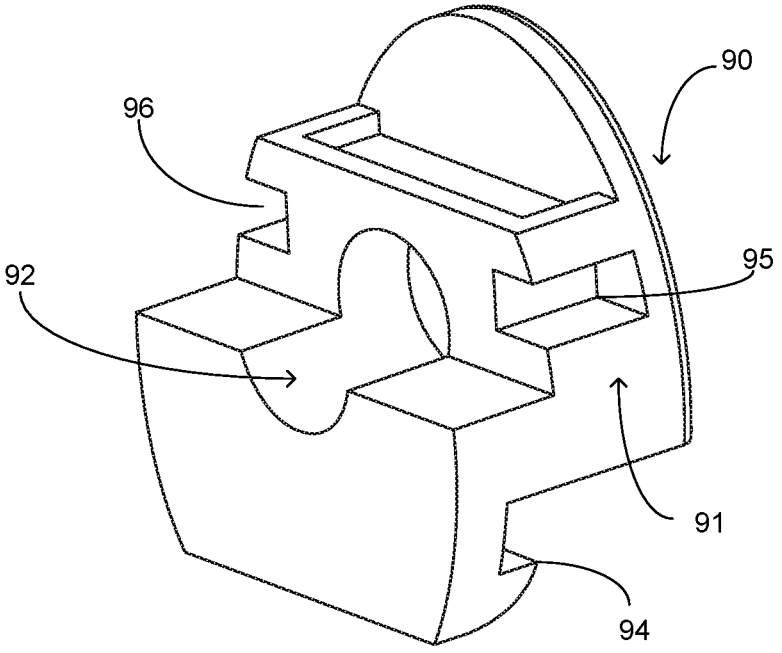
FIG. 7 is a rear perspective view of the latch of the present invention.

While not particularly illustrated herein, the container member module 25 includes an interior volume that is operable to receive and retain the grindings of the herb that has propagated through the apertures 32. It is contemplated within the scope of the present invention that the container member module 25 include a filtration element such as but not limited to a screen at the bottom of the interior volume thereof. The interior volume of the container member module 25 is accessible when the upper portion 50 of the body 5 has been removed from the lower portion 60. The bottom member module 15 is illustrated herein in FIG. 6. The bottom member module 15 includes a small interior volume 16 defined by wall 17 wherein the interior volume 16 is configured to receive and retain any particles that have fallen from the container member module 25. The wall 17 has threads 18 formed on the outer surface wherein the threads 18 provide a technique to operably couple the bottom member module 15 to the container member module 25.

Figure 8:
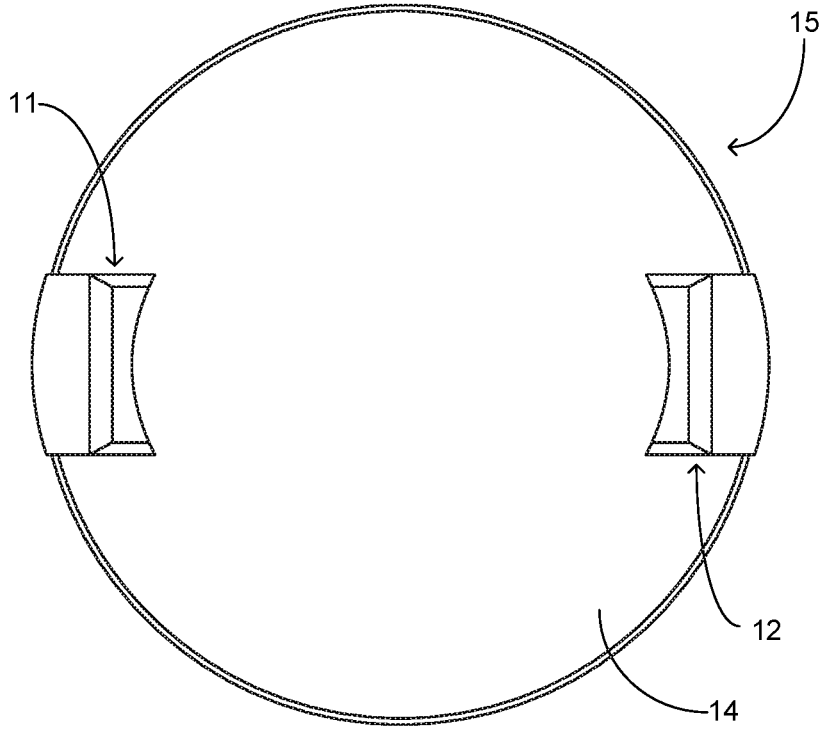
FIG. 8 is a bottom view of the bottom member module.

Referring in particular to FIG. 8, the bottom member module 15 includes a bottom surface 14 that is flat in form so as to facilitate the body 5 being placed in an upright position in the first configuration of the configurable herb grinder 100 as is shown in FIG. 1 herein. The bottom surface 14 has formed therein additional latch receptacles 11, 12 which are similar in structure to latch receptacles 75, 85. The latch receptacles 11, 12 facilitate the ability for the modules 7 to be operably coupled when stacked in the second configuration of the body 5. In the second configuration of the body 5, the container member module 25 and the bottom member module 15 are the two uppermost modules 7 in the stack of modules. The latch receptacles 11, 12 operably engage the latch 90 as the second grinding member module 35 and first grinding member module 45 are now beneath the bottom member module 15 and container member module 25. This second configuration of the body 5 provides the interior volume of the container member module 25 in an accessible position for the user to engage the herbs therein and further ensures the modules 7 of the body 5 of the configurable herb grinder 100 are operably coupled in a vertical stacked configuration.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A configurable herb grinder that is operable to provide grinding of herbs for a user, wherein the herb grinder comprises:

a body, said body having four modules, said four modules being operably coupled in a vertically stacked orientation, said four modules being organized into an upper portion and a lower portion, said upper portion consisting of two of the four modules, said lower portion consisting of the other two of the four modules, said first module and said second module configured to be rotatably engaged with each other, said first module having a plurality of teeth in an interior volume thereof, said second module having a plurality of teeth in an interior volume thereof;

at least one latch receptacle, said at least one latch receptacle configured to have a latch disposed therein, the latch configured to releasably couple the upper portion and the lower portion of the body, and said latch configured to be depressed by a user to release said upper portion from said lower portion, the second module further includes a bottom in the interior volume thereof, said bottom of the interior volume of the second module having a plurality of apertures, the latch further includes a biasing element holder, said biasing element holder configured to house a biasing element that is operable to provide movement control of the latch, and the fourth module includes a bottom surface, said bottom surface being distal to said third module, said bottom surface of said fourth module further including at least one latch receptacle.

2. The configurable herb grinder as recited in claim 1, wherein the body of the configurable herb grinder is configurable between a first configuration and a second configuration.

3. The configurable herb grinder as recited in claim 2, wherein in the first configuration of the herb grinder, the first module and the second module comprise the upper portion of the body, and the third module and the fourth module comprise the lower portion of the body.

4. The configurable herb grinder as recited in claim 3, wherein in the second configuration of the herb grinder, the third module and the fourth module comprise the upper portion of the body, and the first module and the second module comprise the lower portion of the body.

5. An herb grinder that is operable to provide grinding of herbs, wherein the herb grinder is movable between a first configuration and a second configuration wherein the herb grinder comprises:

a body, said body having an upper end and a lower end, said body being comprised of a bottom member module, a container member module, a first grinding member module and a second grinding member module, wherein the bottom member module, the container member module, the second grinding member module and the first grinding member module are arranged in a vertically stacked orientation, said first grinding member module and said second grinding member module being organized into an upper portion, said bottom member module and said container member module being organized into an lower portion, said first grinding member module being rotatably coupled to said second grinding member module, said first grinding member module having a plurality of teeth in an interior volume thereof, said second grinding member module having a plurality of teeth in an interior volume thereof;

two latch receptacles, said two latch receptacles being opposedly located on said body, said two latch receptacles each configured to have a latch disposed therein, each said latch configured to releasably couple the upper portion and the lower portion of the body, and each said latch configured to be depressed by a user to release said upper portion from said lower portion;

and wherein the upper portion and the lower portion are comprised of alternate modules in the first configuration and the second configuration, said bottom member module further includes an interior volume, said interior volume of said bottom member module configured to receive and retain herb particles from said container member module, at least two magnets, wherein one of said at least two magnets is disposed in said first grinding member module, and wherein the other of said at least two magnets is disposed in said second grinding member module, and each of said two latch receptacles includes two guide members, said guide members being formed on opposing sides of each said latch receptacle.

6. The herb grinder as recited in claim 5, wherein each said latch further includes opposing slots, said opposing slots being opposedly located on an upper portion of a body of each said latch, said opposing slots configured to be mateable with said two guide members.

7. The herb grinder as recited in claim 6, wherein each said latch further includes a lower lip member, said lower lip member configured to engage an adjacent module therebeneath.

8. The herb grinder as recited in claim 7, wherein said bottom member module further includes a bottom surface, said bottom surface further having a first latch receptacle and a second latch receptacle, said first latch receptacle and said second latch receptacle being diametrically opposed on said bottom surface.

9. The herb grinder as recited in claim 8, wherein in the first configuration of the herb grinder, the first grinding member module and the second grinding member module comprise the upper portion of the body, and the container member module and the bottom member module comprise the lower portion of the body.

10. The herb grinder as recited in claim 9, wherein in the second configuration of the herb grinder, the container member module and the bottom member module comprise the upper portion of the body, and the first grinding member module and the second grinding member module comprise the lower portion of the body.

11. The herb grinder as recited in claim 10, wherein in said second configuration, the two latches are operable to engage the first latch receptacle and the second latch receptacle located on the bottom surface of the bottom member module.

* * * * *